United States Patent [19]

Baram

[11] 3,997,106

[45] Dec. 14, 1976

[54] CENTRIFUGE ROTOR

[75] Inventor: Martin Baram, Brondby Strand, Denmark

[73] Assignee: F. L. Smidth & Co., Cresskill, N.J.

[22] Filed: Nov. 14, 1974

[21] Appl. No.: 523,753

[30] Foreign Application Priority Data

Nov. 20, 1973 Denmark ..... 6250/73

[52] U.S. Cl. ..... 233/27; 233/1 E

[51] Int. Cl.[2] ..... B04B 1/00

[58] Field of Search ..... 233/1 R, 1 E, 26, 27, 233/28; 57/76

[56] References Cited

UNITED STATES PATENTS

| | | | |
|---|---|---|---|
| 2,008,037 | 7/1935 | Quantin | 57/76 X |
| 2,436,726 | 2/1948 | Moyer | 57/76 |
| 2,965,220 | 12/1960 | Naul | 57/76 |
| 3,797,737 | 3/1974 | Kadotani et al. | 233/27 |

FOREIGN PATENTS OR APPLICATIONS

| | | | |
|---|---|---|---|
| 1,123,042 | 6/1956 | France | 233/27 |

*Primary Examiner*—George H. Krizmanich
*Attorney, Agent, or Firm*—Pennie & Edmonds

[57] ABSTRACT

A centrifuge rotor which is laminated and consists of at least two layers of different materials, a mechanically stronger layer being outermost and a chemically more resistant layer being positioned as an inner filler material. A method of forming a centrifuge rotor laminated and consisting of at least two layers of different materials is also disclosed.

9 Claims, 4 Drawing Figures

CENTRIFUGE ROTOR

BACKGROUND OF THE INVENTION

1. Field of the Invention

The invention relates to an improved centrifuge rotor for use as part of a centrifuge.

2. Description of the Prior Art

In the prior art it has been known in various technical fields to utilize structural materials which are composed of laminations of several types of materials. The reasons for such laminations have been partially to provide greater resistance to structural loads as well as resistance to corrosion and partially to avoid any unnecessary use of costly materials.

Centrifugal rotors of the type described herein have never, insofar as I can determine, been produced as laminations of several types of materials. Up to the present no methods have been devised whereby such construction of centrifugal rotors would have been possible.

SUMMARY OF THE INVENTION

A centrifuge rotor for use as part of a rotating centrifuge which comprises a lamination of at least two layers of different materials, a first material forming an outermost layer, and a second material forming an innermost filler, the outermost layer being of greater mechanical strength than the innermost filler, and said innermost filler being preferably of a relatively chemically resistant material, such as a plastic material.

My invention also pertains to a method of manufacturing such laminated rotors for use as part of a rotating centrifuge comprising taking a cover configured in the shape of an outermost layer of the desired rotor, rotating said cover while simultaneously pouring filler material in a liquid state into said cover, continuing said rotation of said cover until the filler material is at least partially solidified to form an inner portion of a centrifuge rotor, and finishing the surfaces of said outermost and innermost layers to form said rotor.

With a rotor constructed according to my invention it is now possible to utilize the most up to date materials or a combination of known and new materials so as to achieve optimum strengths, resistance to corrosion, low specific gravity, and ease of finishing the materials such that they may be finally configured in the form of a rotor while maintaining the cost of manufacture and operation at extremely low levels.

It can be seen that the method of manufacturing the rotor according to my invention lends itself to various advantageous features which may or may not be utilized as part thereof. For example, the innermost material layer is preferably a plastic material which may be poured in liquid form into a rotating centrifuge cover in intermittent predetermined quantities (or batches) to form several laminations which cover each other and which are in adjacent relation to each other. By altering the direction of rotating of the cover between the pouring of each batch, it can be seen that a still greater reinforced structure of laminated materials will be possible.

Another advantageous feature in the practice of the method of my invention resides in heating an outermost layer in the form of a metallic cover while filling it with a liquid plastic material filler. Since the shrinkage of the metal during the subsequent cooling thereof normally exceeds the shrinkage of the plastic material, the metal cover will create biasing forces against the innermost plastic layer, thus providing inwardly directed forces which would affect the normally outwardly directed centrifugal forces to which the rotor is subjected during operation of the centrifuge.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
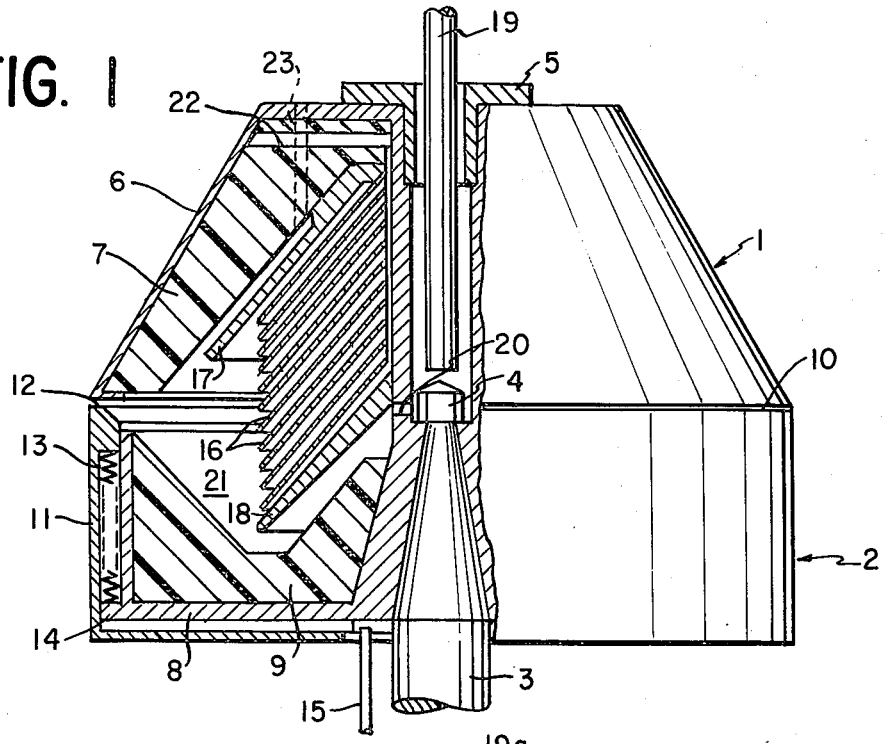
FIG. 1 illustrates a centrifuge rotor, partially in cross-section, and comprised of laminated structures according to the invention.

The rotor disclosed belongs to the so-called self-cleaning type of disc centrifugal separators. It is a matter of course that the invention is not limited to the said type of centrifugal separator.

The rotor consists of an upper part and an under part, 1 and 2, respectively, which are driven by a shaft 3 via a nut 4 and assembled by means of a nut 5. The upper part consists in this case of a cover 6 which may be of steel, and a filler 7 which may be plastics. The under part 2 consists of a cover 8 and a filler 9. Between the upper and the under parts 1, 2 is an ejection slot 10 which is opened and closed by means of an annular piston 11 with a sealing ring 12 which can be moved up and down in connection with springs 13 and a liquid chamber 14. A control liquid is conveyed through a stationary pipe 15 to the chamber 14. The rotor is further provided with known discs 16 between an upper and a lower partition plate, 17 and 18, respectively.

In operation, the centrifuge liquid enters the rotor through a stationary pipe 19, flows through bores 20, and past the lower partition plate 18 into a centrifuging chamber 21, from which the lighter phase leaves the rotor through bores 22 after passing the discs 16, whereas the heavier phase flows across the upper plate 17 and is ejected through bores 23.

Figure 2:
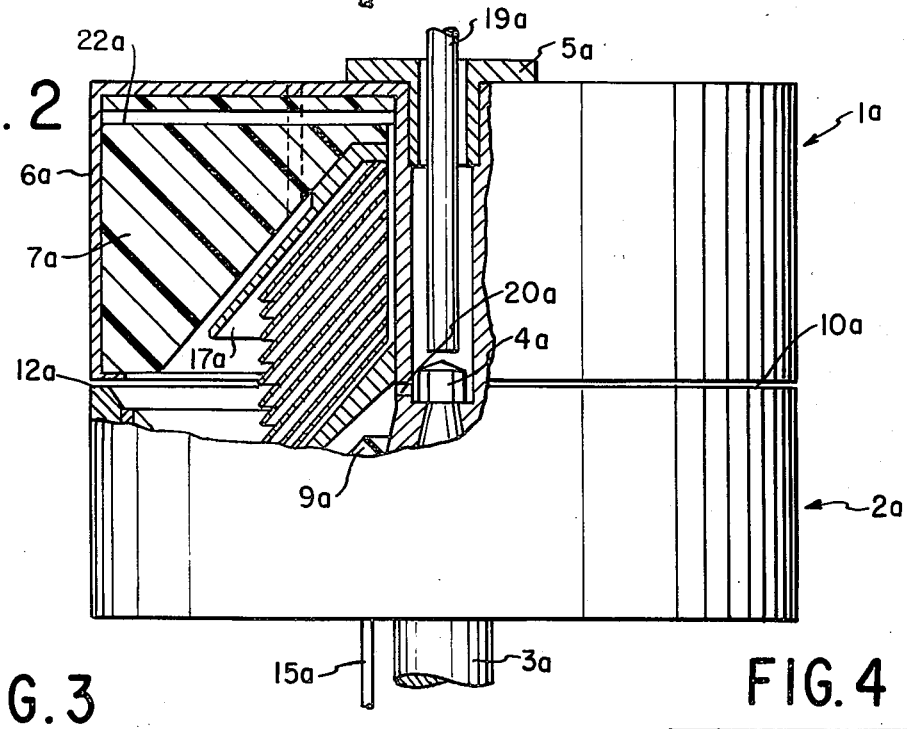
FIG. 2 illustrates an alternate embodiment of the rotor of FIG. 1.

Referring to FIG. 2 there is shown an alternate form of the rotor illustrated in FIG. 1 with the exception that it has a cylindrical, rather than the tapered/cylindrical configuration shown in FIG. 1. However like components bear the same identification numbers with the letter designation a added thereto.

Figure 3:
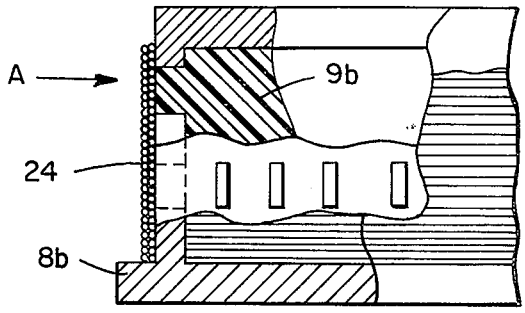
FIG. 3 illustrates an alternate embodiment of the rotor of FIGS. 1 and 2.
Figure 4:
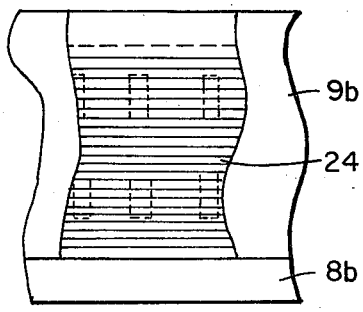
FIG. 4 illustrates a view taken in the direction A of FIG. 3.

FIGS. 3 and 4 illustrate alternate embodiments of the rotor of FIGS. 1 and 2 wherein a wire material 24 is wound about the cover 8 of the lower part 2. The technique illustrated in these FIGS. — while only shown with respect to the underpart 2 of the rotor — is also applicable to the upper part 1 of the invention. The wire material may comprise piano strings wound about the inner filler portion, or alternately the wire may be wound about a steel outermost layer. FIG. 3 illustrates such a steel outermost layer having wire material 24 wound therearound and an innermost filler material **9*b***. The steel outermost layer may be perforated to allow plastic material to adhere to the wire material or piano strings. With the wire wrapped around the steel outermost layer, this embodiment will obviously be comprised of three layers, with the steel layer being positioned intermediate the wire material and the inner filler material layer.

Also it should be noted that the innermost filler layer may be in the form of a plastic material having fibrous material interspersed throughout to reinforce the plastic filler material.

I claim:

1. A rotor for use as part of a rotating centrifuge which comprises a lamination of at least three layers of different materials, a first material forming an innermost filler, a second material forming an intermediate layer and defining a plurality of perforations therein, a third outermost layer in the form of wire material positioned about the intermediate layer, the intermediate and outermost layers being of greater mechanical strength than the innermost filler material and the innermost filler material being relatively chemically resistant, at least said outermost layer being prestressed to provide inwardly directed bias forces against the innermost filler material and portions of the innermost filler material being positioned within perforations defined by said intermediate layer and adhered to portions of the wire material of the outermost layer thereby providing a rotor of improved mechanical strength while the bias forces on the innermost layer counteract at least part of the operative centrifugal forces of the centrifuge rotor during rotation.

2. The centrifuge rotor according to claim 1 wherein the outermost material layer of said rotor is comprised of at least one of fibers and carbon wires wound about the innermost layer and the innermost layer is formed of a chemically resistant plastic material.

3. The centrifuge rotor according to claim 1 wherein the outermost layer of said rotor is comprised of a metal wire material and the innermost layer is formed of at least one chemically resistant plastic material.

4. The centrifuge rotor according to claim 1 wherein the outermost layer of said rotor is comprised of steel piano strings and the innermost layer is formed of at least one chemically resistant plastic material.

5. The centrifuge rotor according to claim 4 wherein the intermediate layer is comprised of steel.

6. The centrifuge rotor according to claim 5 wherein the intermediate layer is comprised of high tensile strength steel.

7. The centrifuge rotor according to claim 6 wherein the innermost layer is comprised of a chemically resistant plastic filler material, the intermediate layer is comprised of high tensile strength plate steel having a circular cross-sectional configuration and defining perforations spaced thereabout, and the outermost layer is comprised of steel piano strings wound thereabout in a prestressed condition to provide inward bias forces at least on the innermost layer of plastic filler material.

8. The centrifuge rotor according to claim 7 wherein said piano strings of said outermost layer of said centrifuge rotor have a smooth surface formed by portions of the innermost filler material positioned within said perforations of said intermediate layer and adhered to the under surface and outer surface of said wire material and the interstices between the individual portions of wire material.

9. The centrifuge rotor according to claim 8 wherein the plastic filler material further comprises fibrous materials interspersed therein to reinforce said plastic filler material.

* * * * *